US009650806B2

(12) United States Patent
Beck et al.

(10) Patent No.: US 9,650,806 B2
(45) Date of Patent: May 16, 2017

(54) DOOR HANDLE ASSEMBLY FOR A MOTOR VEHICLE

(71) Applicants: Andreas Beck, Bochum (DE); Dirk Mueller, Essen (DE); Raimund Huebner, Wuppertal (DE); Matthias Loew, Ratingen (DE)

(72) Inventors: Andreas Beck, Bochum (DE); Dirk Mueller, Essen (DE); Raimund Huebner, Wuppertal (DE); Matthias Loew, Ratingen (DE)

(73) Assignee: Huf Huelsebeck & Fuerst GmbH & Co. KG, Velbert (DE)

( * ) Notice: Subject to any disclaimer, the term of this patent is extended or adjusted under 35 U.S.C. 154(b) by 99 days.

(21) Appl. No.: 14/701,017

(22) Filed: Apr. 30, 2015

(65) Prior Publication Data

US 2015/0337559 A1 Nov. 26, 2015

(30) Foreign Application Priority Data

May 26, 2014 (DE) ..... 10 2014 107 406

(51) Int. Cl.
*E05B 3/00* (2006.01)
*E05B 3/04* (2006.01)
(Continued)

(52) U.S. Cl.
CPC ..... *E05B 3/04* (2013.01); *E05B 7/00* (2013.01); *E05B 85/16* (2013.01); *E05B 77/34* (2013.01); *E05B 79/06* (2013.01); *Y10T 292/57* (2015.04)

(58) Field of Classification Search
CPC ..... E05B 1/003; E05B 1/0038; E05B 1/0046; E05B 1/0053; E05B 1/0084;
(Continued)

(56) References Cited

U.S. PATENT DOCUMENTS

2003/0189340 A1* 10/2003 Kitzis ..... B65F 1/1615 292/145
2005/0093306 A1* 5/2005 Pudney ..... E05B 85/16 292/216
2012/0272695 A1* 11/2012 Pickar ..... E05C 1/145 70/91

FOREIGN PATENT DOCUMENTS

DE 10 2005 049 027 A1 4/2007
DE 10 2007 027847 A1 12/2008
(Continued)

OTHER PUBLICATIONS

European Search Report of EP 15 161 250.4 dated Oct. 1, 2016, 3 pages.

*Primary Examiner* — Kristina Fulton
*Assistant Examiner* — Faria Ahmad
(74) *Attorney, Agent, or Firm* — Fay Sharpe LLP

(57) ABSTRACT

A door handle assembly for a motor vehicle has a handle mount, a handle and a coupling device, wherein the handle is coupled to the coupling device in the region of its second handle end which provides a door handle assembly in a structurally simple manner, in which the play in the longitudinal direction of the handle mount, and thus the clearance in the opening in the door panel for the handle ends, is reduced to a minimum. This is achieved in that the second handle end of the handle and a deflection lever of the mechanical coupling device are moveably coupled to one another by a pivotable and hinge-like articulated connection of the second handle end in relation to the deflection lever, when the handle has been actuated.

14 Claims, 5 Drawing Sheets

(51) Int. Cl.

| | |
|---|---|
| ***E05B 7/00*** | (2006.01) |
| ***E05B 85/16*** | (2014.01) |
| *E05B 77/34* | (2014.01) |
| *E05B 79/06* | (2014.01) |

(58) Field of Classification Search

CPC .. E05B 1/0092; E05B 1/06; E05B 2001/0076; E05B 3/00; E05B 5/00; E05B 5/003; E05B 5/006; E05B 7/00; E05B 81/64; E05B 81/76; E05B 81/77; E05B 81/78; E05B 85/10; E05B 85/103; E05B 85/107; E05B 85/12; E05B 85/13; E05B 85/14; E05B 85/16; E05B 85/18; E05B 3/04; E05B 77/34; E05B 79/06; E05C 1/04; E05C 1/06; E05C 1/065; E05C 1/10; E05C 1/12; E05C 1/14; E05C 1/145; E05C 1/16; E05C 1/166; E05C 3/04; E05C 3/00; E05C 3/043; E05C 3/044; E05C 3/047; E05C 3/048; E05C 3/06; E05C 3/08; E05C 3/10; E05C 3/14; E05C 3/145; E05C 3/16; E05C 3/162; E05C 3/165; Y10T 292/57

USPC ..... 292/336.3, DIG. 30, DIG. 22, DIG. 31, 292/DIG. 27

See application file for complete search history.

(56) References Cited

FOREIGN PATENT DOCUMENTS

| | | | |
|---|---|---|---|
| DE | 10 2009 043933 | A1 | 3/2011 |
| WO | WO 2015/106784 | A1 | 7/2015 |

* cited by examiner

DOOR HANDLE ASSEMBLY FOR A MOTOR VEHICLE

BACKGROUND

The invention relates to a door handle assembly for a motor vehicle, having a handle mount, a handle for opening a door or hatch on the motor vehicle, and a mechanical coupling device, wherein the handle is pivotably supported, in the region of its first handle end, on the handle mount that can be installed on the inside of the vehicle, and, in the region of its second handle end, is coupled to the mechanical coupling device, which is pivotably supported on the handle mount, and by means of which, an actuation of the handle can be transferred to a vehicle-side locking assembly.

Door handle assemblies of this type, for a motor vehicle, can be executed as internal or external handles, wherein the present invention primarily relates to a door handle assembly for an external handle. There are numerous different constructions and embodiments for such door handle assemblies. The design according to the invention of a door handle relates to such designs with which the handle mount, on one hand, and the handle, on the other hand, are attached to one another from opposite sides of the door of the motor vehicle. The handle mount is attached thereby on the back of the door, i.e. on the inside of the motor vehicle, while the handle is mounted on the outside of the door, thus on the outside of the motor vehicle. After installation, the two handle ends of the handle pass through respective holes in the door, or in the door panel of the motor vehicle.

A door handle assembly of the type described above is known, for example, from DE 10 2005 049 027 A1. This known door handle assembly has a handle mount, which is attached to the inside of the door, or the door panel, a handle, and a coupling device having a deflection lever. The handle is attached to the outside of the door thereby, in that the two handle ends of the handle are fed through respective openings in the door, and fastened to the handle mount. The first handle end of the handle is pivotably supported thereby on the handle mount, in a floating manner. The play in the longitudinal direction of the handle mount associated with this type of bearing is necessary, because the second handle end of the handle is non-pivotably connected to the deflection lever of the coupling device. As a result, due to the floating bearing of the first handle end, and the fixed support of the second handle end, correspondingly large clearances must be taken into account, which has a negative effect on the tightness of overall door handle assembly. In addition, the floating bearing for the first handle end results in the handle being able to wiggle slightly, or even noticeably, or to be able to execute a rocking movement, when actuated for opening a door or hatch on the motor vehicle, which may result in the user having the impression that the handle is not functioning properly.

BRIEF SUMMARY

The invention addresses the object of providing a solution resulting in a door handle assembly having a simple construction, which can be manufactured inexpensively, and with which the handle can be mounted on the handle mount in a simple, quick and convenient manner. In particular, a door handle assembly is to be provided, with which the play in the longitudinal direction of the handle mount, and thus the clearance in the openings in the door panel for the handle ends is reduced to a minimum.

With a door handle assembly of the type described in the introduction, the object is achieved, according to the invention, that the second handle end of the handle, and a deflection lever of the mechanical coupling device are moveably coupled to one another by means of a pivotable and hinge-like articulated connection of the second handle end in relation to the deflection lever, when the handle has been actuated.

Advantageous and practical designs and developments of the invention can be derived from the dependent claims.

A door handle assembly for a motor vehicle is made available by the invention, distinguished by a functional construction and a simple and inexpensive structure. With the door handle assembly according to the invention, the articulated connection designed in the manner of a hinge ensures that the second handle end of the handle can be pivoted in relation to the deflection lever. Thus, the second handle end of the handle is now no longer non-pivotably attached to the deflection handle. As a result of this obtained degree of freedom, it is possible for the first handle end of the handle to be tightened in a fixed manner to the handle mount, by means of which the play in the first handle end of the handle in the axial direction, or in the longitudinal direction of the handle mount, and as a result thereof, the clearance, can be reduced to a minimum, enabling the use of simple and inexpensive tightening measures for the door handle assembly, by means of which the manufacturing costs for the overall door handle assembly are reduced. Furthermore, the support and movement guidance of the handle now no longer must occur at the first handle end with the door handle assembly according to the invention. Instead, with the door handle assembly according to the invention, the deflection lever guides the movement of the handle when it is actuated, such that the attachment of the first handle end, which is important for the pivotal movement of the handle in door handle assemblies from the prior art, can occur with constructively simple means and inexpensively.

A particularly simple possibility for obtaining the hinge-like articulated connection exists in the design of the invention, in that the articulated connection is designed in the manner of a pivot joint or hinge, and the deflection lever for the coupling device is pivotably connected to the handle in the region of the second handle end. This possible design uses a minimum of components, because, by way of example, a bolt or screw connection, which pivotably connects the deflection lever to the second end of the handle, is sufficient for obtaining the pivot joint, or hinge.

As an alternative to the design of the articulated connection as a pivot joint or hinge, the invention provides that the articulated connection comprises a joint element which is non-pivotably connected via a form-locking connection to a handle hook of the handle, formed on the second handle end, and which is pivotably connected to the deflection lever via a pivot joint connection. Thus, an intermediate piece is provided in the form of the joint element between the handle hook and deflection lever, which provides for a type of bending, in which the joint element is pivoted in relation to the deflection lever, and an extension, in which the joint element is disposed basically in a line, or flush, with the deflection lever, when the handle is actuated in order to open the door or hatch.

In order to securely attach the handle hook to the joint element, to ensure the moveable coupling with the deflection lever, there is a structurally simple possibility, in that the form-locking connection comprises a screw, screwed into a thread in the joint element, which fixes the free end of the handle hook in place.

In this regard, the screw can be screwed to the handle hook, which, however, requires an additional thread, and would increase the maintaining of manufacturing tolerances, in order that the screw can also actually be screwed to the joint element as well as to the handle hook. For this reason, the invention provides, in an advantageous design, instead, that with the form-locking connection, the screw is inserted through a hole formed on the free end of the handle hook, and the screw is screwed into the joint element with its screw head lying against the joint element.

With a door handle assembly according to the type indicated in the introduction, the handle mount is first attached to the back surface of the door (on the inside), and only after this, the handle is installed from the outside of the door (on the outside). The first handle end of the handle is pivotably attached to the handle mount thereby, and the second handle end of the handle is releasably attached to the mechanical coupling device, which is already pivotably supported on the handle mount attached to the inside of the door. In order to facilitate this attachment of the second handle end, or the handle hook, to the coupling device, the coupling device, designed in the manner of a lever, must be moved to an installation position, by means of which the handle hook that is to be coupled to the second handle end of the handle is disposed in the proximity of the hole in the door allocated thereto. The installation position is to be maintained thereby, until the attachment of the second handle end, or handle hook, of the handle has been completed. For this, until now, locking elements have been necessary in the prior art, which are difficult to bring into their locking position, and then released therefrom, and in some cases, must then be dismantled. This is no longer necessary with the door handle assembly according to the invention, because, in this regard, the invention provides in its design that, in order to install the free end of the handle hook of the handle on the deflection lever of the coupling device, the deflection lever is fixed in place in terms of its movement using the screw, in that the screw is screwed out of the joint element, such that it protrudes from the joint element, such that its screw head lies against one of the contact surfaces formed on the coupling device, such that a relative movement between the joint element and the coupling device is blocked. The contact surface can be designed thereby such that the head surface and/or the circumferential surface of the screw head is supported in sections.

In order to obtain a modular construction of the door handle assembly, in which the individual components can be easily connected, and disassembled, as well as replaced, it is furthermore provided in the design of the invention that the pivot joint connection comprises at least one receiving recess formed in the joint element, and at least one joint pin protruding laterally from the deflection lever, wherein the at least one joint pin is pivotably supported in the at least one receiving recess. The at least one joint pin on the deflection lever is thus inserted in the manner of a plug-in connection in the corresponding receiving recess formed in the joint element.

In order to prevent lateral movements of the joint pin in the receiving recess, the invention provides, in a further design, that the at least one receiving recess is designed with at least one step in the cross-section, and the at least one joint pin has, at least in sections, an expanded head, of which at least one section is disposed such that it lies behind the at least one step inside the joint element. The joint pin thus has a type of flange, which rests against the step in the receiving recess, and blocks a lateral movement of the joint pin in the receiving recess in the manner of a rail.

It is then further provided in the design of the invention that the joint element has an installation funnel facing the screw head, for inserting and orienting a tool for adjusting the position of the screw in the joint element. The tool necessary for a change between the installation state and the operating state, such as a screwdriver, can be inserted in a simple manner as a result, without the tool having to be brought into position by means of special skills.

In this regard, there is a further possibility for facilitating the installation, in that an additional funnel of an installation aid is disposed in a virtual extension of the installation funnel, wherein the installation aid is secured on the handle mount by means of locking connection elements, such that it can be dismantled, or is designed as an integral part of the handle mount.

By means of the door handle assembly according to the invention, having the joint element designed in the manner of a hinge, in contrast to door handle assemblies from the prior art, with which the handle hook of the handle is non-pivotably connected to the deflection lever of the mechanical coupling device, there is now the possibility that the first handle end of the handle is tightened down in a fixed manner. As a result of the secure tightening of the first handle end of the handle, there is no longer any play in the longitudinal direction of the door handle mount, such that rocking movements of the handle when it is actuated no longer occur for the most part, giving the appearance of a higher quality to the overall door handle assembly.

BRIEF DESCRIPTION OF THE DRAWINGS

It is to be understood that the features specified above, and to be explained below, can be used, not only in the respective combinations given herein, but also in other combinations or in and of themselves, without abandoning the scope of the present invention. The scope of the invention is defined only by the claims.

Further details, features and advantages of the subject matter of the invention can be derived from the following description, in conjunction with the drawings, in which a preferred embodiment example of the invention is depicted, by way of example. In the drawings.

DETAILED DESCRIPTION

Figure 1:
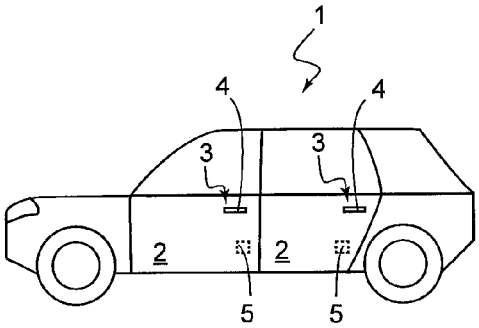
FIG. 1 shows a side view of a motor vehicle having numerous door handle assemblies according to the invention.

A vehicle, or motor vehicle 1, respectively, in the form of a passenger car, is depicted by way of example in FIG. 1, having four doors 2 in the example (two of which are visible in FIG. 1), which can be opened by means of a door handle, or a handle 4. The doors 2 are closed in a fixed manner via respective closing assemblies 5, and can be opened from the outside only by means of a respective movement of the handle 4. This movement of the handle 4 can be composed of a pulling and/or lifting movement, wherein the movement of the handle 4 is mechanically transferred by at least one (mechanical) coupling device 6 (see FIG. 3 or 4, by way of example) to the corresponding closing assembly 5. By moving the handle 4, the corresponding closing assembly 5 and thus the associated door 2 can then be opened.

Figure 2:
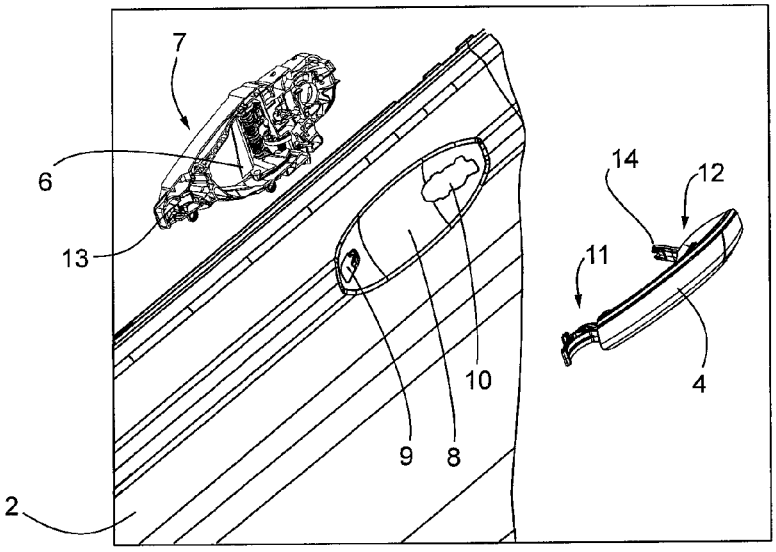
FIG. 2 shows a perspective view of a door, on the inside of which a handle mount, and on the outside of which a handle, are disposed, to form a door handle assembly according to the invention.

The door handle assembly 3 is depicted in greater detail in FIGS. 2 to 17 in various views for various positions. As can be seen, in particular, in FIGS. 2, 3 and 4, the door handle assembly 3 has a frame-like handle mount 7, wherein, for reasons of clarity, a depiction of the handle 4 is omitted in FIG. 3. The handle mount 7 serves, in the known manner, for the attachment of the handle 4, and is attached to the inside of the door 2 (on the inside) by means of screw connections, not shown in greater detail, wherein the handle 4 is disposed on the outside of the door 2 (on the outside), as indicated in FIG. 2. In order to save on materials, the handle mount 7 is substantially designed as a frame structure, having various receiving and bearing spaces, in order to be able to accommodate the handle 4, among other things, which is moveably and/or pivotably supported on the handle mount 7 in order for a user to be able to open a corresponding door 2 of the motor vehicle 1.

As is shown in FIG. 2, the door 2 has a handle recess 8 with two holes 9 and 10, through which the bowed handle 4 extends with its first handle end 11 and its second handle end 12 in the assembled state of the door handle assembly 3. The first handle end 11 of the handle 4 is thus inserted through the first hole 9, and tightened in a secure manner to a bearing element 13 on the handle mount 7. The tightening of the handle 4 at the end furthermore enables an upward pivoting of the handle 4 about a vertical axis. The second handle end 12 of the handle 4 extends through the second hole 10 formed in the door after the installation of the door handle device 3, and acts together with the coupling device 6 for actuating the closing assembly 5. The second handle end 12 is designed with a handle hook 14 thereby, and the mechanical coupling device 6 is designed with a deflection lever 15. The deflection lever 15 of the mechanical coupling device 6 is coupled thereby to the free end 16 of the handle hook 14 on the second handle end 12 of the handle 4.

A movement of the handle 4 can be transferred to the corresponding, vehicle-side closing assembly 5 by the mechanical coupling device 6, which is pivotably supported on the handle mount 7, in order to open the corresponding door 2 by this means. The coupling device 6 in the selected embodiment example can be pivoted, against the force of a mechanical return element 17 designed as a spring element, from an inactive position (see FIGS. 12, 14 and 16, for example) when the handle 4 has not been actuated, into an end position (see FIGS. 13, 15 and 17, for example), in which the handle 4 has been actuated, wherein the spring element, or return element 17, forces the coupling device 6, together with the handle 4, out of the end position back into its inactive position. The coupling device 6 is pivotably supported on the handle mount 7 by means of rotational axle elements 18 in corresponding bearing positions 19 on the handle mount 7 (see FIG. 4, for example), wherein the spring element, or return element 17 is held in place by the rotational axle elements 18, and rests against the coupling device 6 as well as the handle mount 7, in order to exert the force acting against the outward pivoting in the course of the outward pivoting, and cause the desired return to the inactive position.

The handle 4 can be coupled with its second handle end 12 to the coupling device 6 pivotably supported on the handle mount 7. The handle 4 is thus moveably coupled to the closing assembly 5 when it is actuated in order to open the door 2 of the motor vehicle 1. For this moveable coupling, the door handle assembly 3 has a joint element 20, in addition to the handle mount 7, the coupling device 6 pivotably supported on the handle mount 7, and the handle 4 attached at its first handle end 11 to the handle mount 7. The joint element 20, which is depicted in detail, for example, in FIGS. 4 to 7, has a through hole 40 (see FIG. 10, for example), having a thread 21 (see FIG. 6, for example), into which a screw 22 is screwed, which serves to fix the handle hook 14 in place. Both the screw head 23 as well as the screw foot 24 exhibit, in each case, a hexagonal socket for manipulating the screw 22, and for its adjustment in the thread, or thread course 21, respectively, with a corresponding tool.

Figure 3:
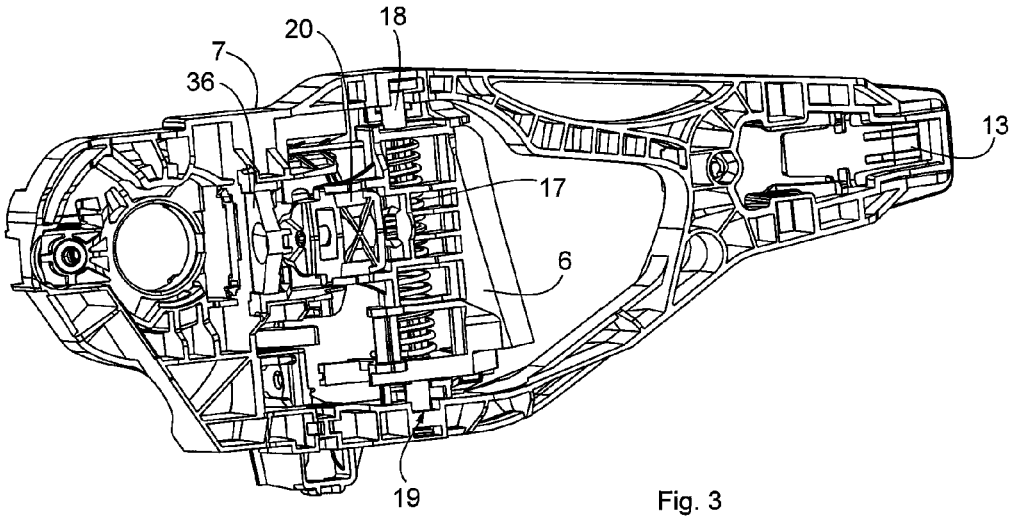
FIG. 3 shows a perspective view of a handle mount for the door handle assembly according to the invention.
Figure 4:
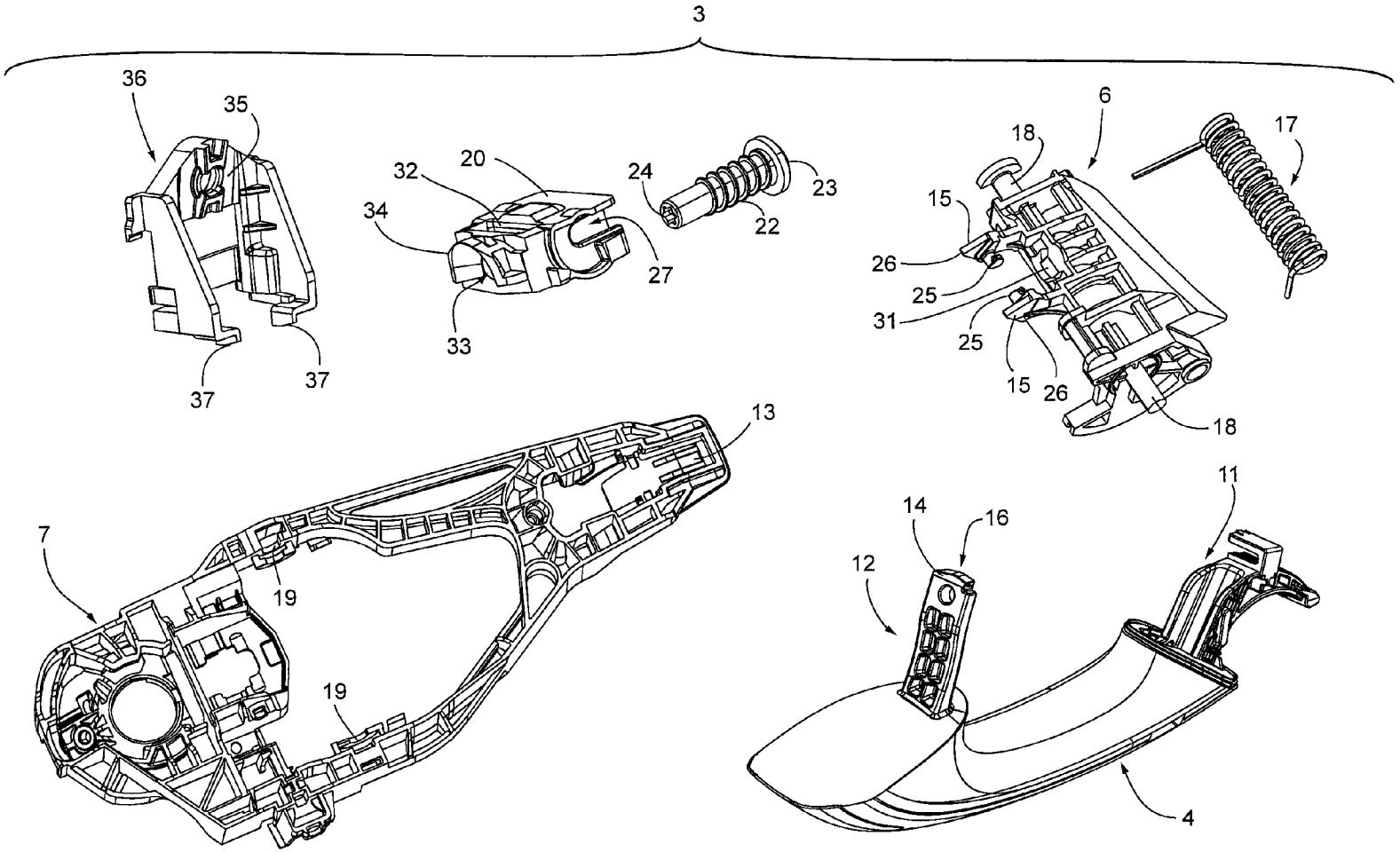
FIG. 4 shows a perspective, detailed depiction of the door handle assembly according to the invention.
Figure 5:
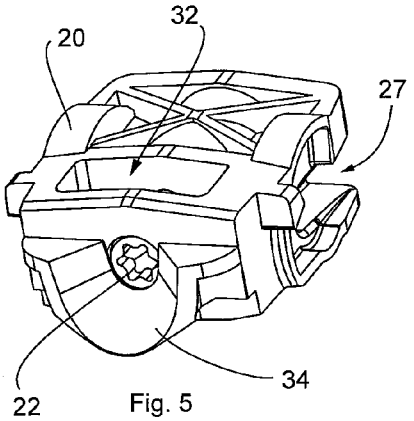
FIG. 5 shows a joint element for the door handle assembly in a perspective view.
Figure 6:
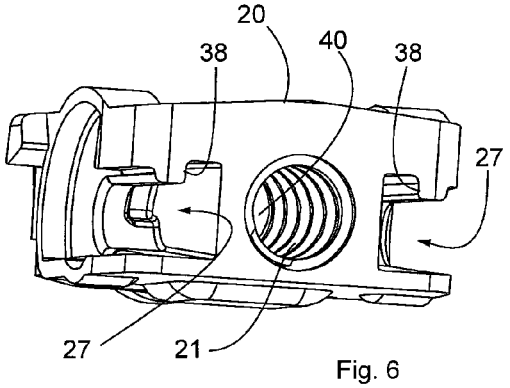
FIG. 6 shows the joint element from FIG. 5 in another perspective view.
Figure 7:
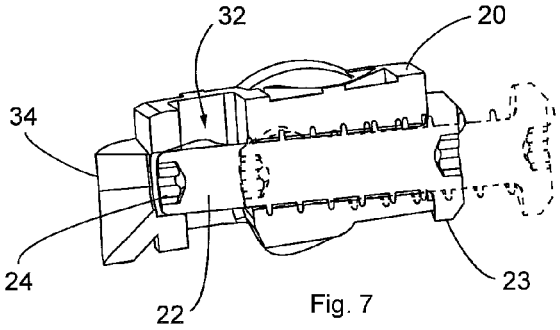
FIG. 7 shows the joint element from FIG. 5 in a sectional view.

For the installation of the door handle assembly 3 according to the invention, the handle mount 7 shown in FIG. 3 is preassembled, i.e. all of the components that are to be attached thereto, such as an emergency lock cylinder, a crash-barrier, etc. are attached to the handle mount 7 prior to the installation of the handle mount 7 on the door 2, and then screwed onto the door 2 of the motor vehicle 1 on the inside thereof. Prior to this, however, the coupling device 6, including the joint element 20, is also attached to the handle mount 7. The mechanical coupling device 6 is inserted with its rotational axle elements 18 in the corresponding bearing positions 19 on the handle mount 7, such that the mechanical coupling device 6 is pivotably supported via the rotational axle elements 18. Subsequently, the joint element 20 is then connected to the mechanical coupling device 6 supported on the handle mount 7. For this, the mechanical coupling device 6 has two joint pins 25 in the depicted embodiment example, onto which the joint element 20 is placed. One respective joint pin 25 extends laterally thereby, from a respective arm 26 of the two-armed deflection lever 15. The two joint pins 25 extend between the two arms 26 of the deflection lever 15. The joint element 20 has receiving recesses 27 formed on the side thereof, and open at one end, which serve to enable the joint element 20 to be placed on the two-armed deflection lever 15 of the coupling device 6, in that the joint pins 25 can be inserted in receiving recesses 27. The joint pins 25 enable the joint element 20 to rotate in relation to the two-armed deflection lever 15, as shall be explained below in detail. The joint pins 25 accommodated in the receiving recesses 27 thus form a pivot joint connection 28 (see FIG. 13, for example) between the joint element 20 and the coupling device 6. In order to form the pivot joint connection 28, it is sufficient when this connection comprises at least one receiving recess 27 formed in the joint element 20 and at least one joint pin 25 protruding laterally from the deflection lever 15, wherein the at least one joint pin 25 must be pivotably supported in the at least one receiving recess 27.

The pivot joint connection 28 is part of an articulated connection 29 (see FIG. 13, for example), by means of which the second handle end 12 can be pivoted in relation to the deflection lever 15 when the handle has been actuated. In addition to the pivot joint connection 28, a form-locking connection 30 belongs to the hinge-like articulated connection 29 (see FIG. 11 or FIG. 13, for example). In this manner, the second handle end 12 of the handle 4 and the deflection lever 15 of the mechanical coupling device 6 are moveably coupled to one another by means of the pivotable and hinge-like articulated connection 29 of the second handle end 12 in relation to the deflection lever 15, when the handle 4 is actuated.

FIGS. 9 to 17 depict, schematically, the interaction of the coupling device 6, the second handle end 12 of the handle 4, and the joint element 20, wherein, for reasons of clarity, by way of example, a depiction of the handle mount 7 is omitted, and instead, only the components that are relevant to the invention are shown and, in particular, described.

Figure 9:
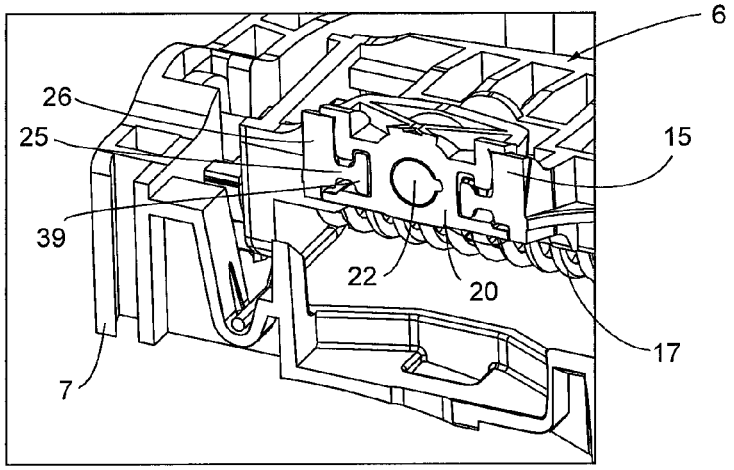
FIG. 9 shows the installation element attached to the coupling device, in a perspective sectional view.
Figure 10:
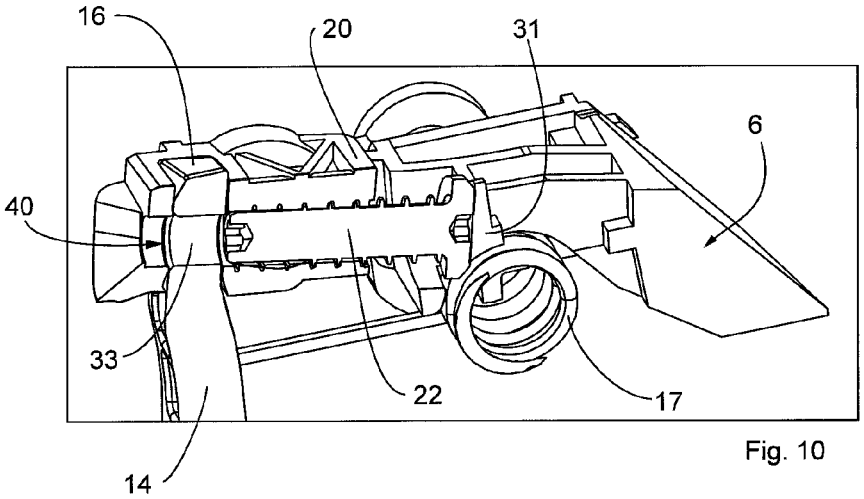
FIG. 10 shows a perspective, lateral, sectional view of the installation element attached to the coupling device, wherein a screw, screwed into the joint element for an installation position and orientation of the joint element and coupling device, provides for an attachment of a handle hook of a handle on the handle mount.
Figure 11:
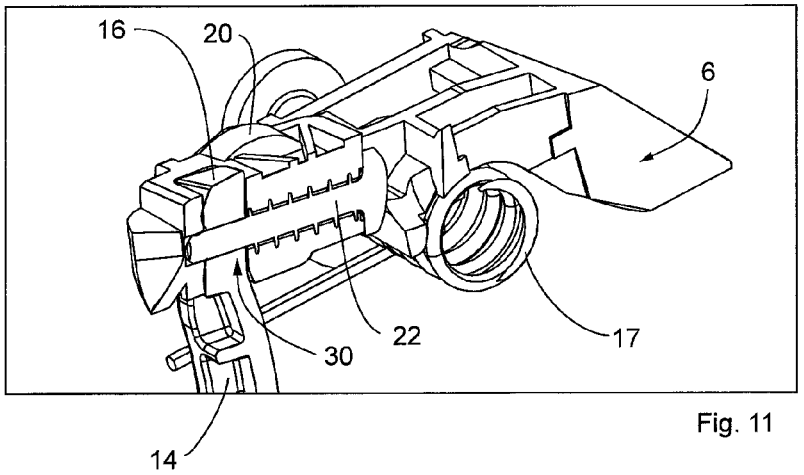
FIG. 11 shows a perspective, lateral, sectional view of the installation element attached to the coupling device, wherein the screw screwed into the joint element provides for an inactive position of the joint element and coupling device, and establishes the operational readiness of the door handle assembly.

In FIGS. 9 and 10, the joint element 20 is connected to the coupling device 6 via the pivot joint connection 28, while in contrast, the handle hook 15 on the second handle end 12 of the handle 4 is not yet attached to the joint element 20. The screw 22 assumes the position depicted by a broken line in FIG. 7 thereby, in which the screw 22 protrudes out of the joint element 20 such that its screw head 23 sticks out. In this position of the screw 22, which characterizes an installation position, the screw head 23 lies against a contact surface 31 formed on the coupling device 6 (see FIG. 10, for example) such that a relative movement between the joint element 20 and the coupling device 6 is blocked. The contact surface 31 is designed in the shape of a semi-circle, and supports not only the disk-shaped end surface of the head surface of the screw head 23, but also the half circumferential lateral surface of the screw head 23. The screw head 23 of the screw 22 is thus supported by the bowl-shaped contact surface 23 in sections, in order to prevent a relative movement between the joint element 20 and the coupling device 6. In this position, or the installation position, respectively, the free end 16 of the handle hook 14 can be inserted in a through chamber 32 (see FIG. 7, for example), which runs such that it is substantially perpendicular to the through hole 40, in order to install the handle 4 on the handle mount 7. In order to form the form-locking connection 30, which is established during the installation of the handle 4, the screw 22 is then inserted through a through hole 33 formed on the free end 16 of the handle hook 14, such that the handle 4 is secured. This state is shown in FIG. 11, in which the screw 22 rests against the joint element 20 with its screw head 23, and is completely screwed into the joint element 20, as is characteristic of the form-locking connection 30. In order to facilitate the manipulation, or handling, of the screw 22, in order to change its position in the joint element 20 from the position shown in FIG. 10 to the position shown in FIG. 11, the joint element 20 has an installation funnel 34 facing the screw 22, which transitions into the through hole 40, and serves for the insertion and orientation of a tool for adjusting the position of the screw 22 in the joint element 20. In order to better orient an appropriate tool to the screw, an additional funnel 35 of an installation aid 36 is disposed in a virtual extension of the installation funnel 34, wherein the installation aid 36 with the additional funnel 35 is purely optional, and is thus expendable. The installation aid 36 is visible, for example, in FIG. 3 or 4, wherein in the depicted embodiment example, the installation aid 36 is securely attached to the handle mount 7 by means of locking connection elements 37, such that it can be dismantled. As an alternative to the locking connection elements 37, the installation aid 36 could also be designed as an integral part of the handle mount 7.

After the installation of the handle 4 on the handle mount 7, as described above, the handle 4 can then be moved between its inactive position (when the handle 4 has not been actuated) and an end position (when the handle 4 has been actuated to open the door 2). The screw 22, which is then fully screwed into the joint element 20 is then disposed running through the through hole 33 of the handle hook 15, and holds the handle hook securely in this manner, or fixes it in place.

Figure 12:
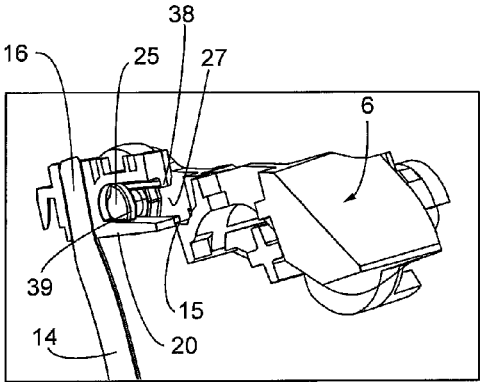
FIG. 12 shows another lateral, sectional view of the coupling device and the joint element in the inactive position, when the handle has not been actuated.
Figure 13:
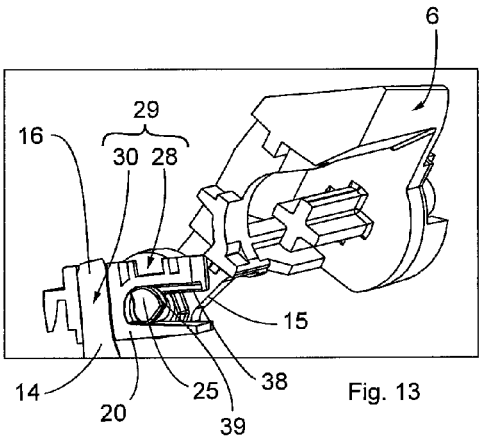
FIG. 13 shows another lateral, sectional view of the coupling device and the joint element in an end position, when the handle has been actuated.
Figure 14:
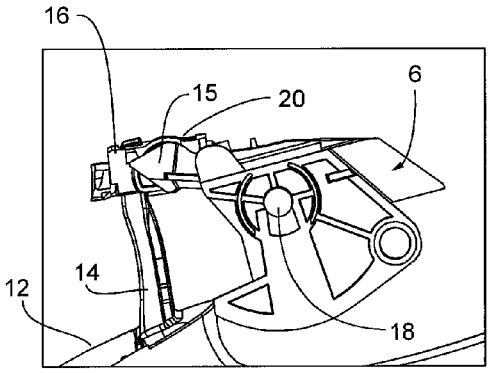
FIG. 14 shows a lateral view of the coupling device and the joint element in the inactive position, when the handle has not been actuated.
Figure 15:
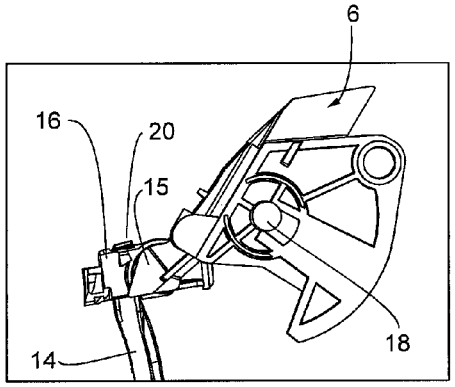
FIG. 15 shows a lateral view of the coupling device and the joint element in the end position, when the handle has been actuated.
Figure 16:
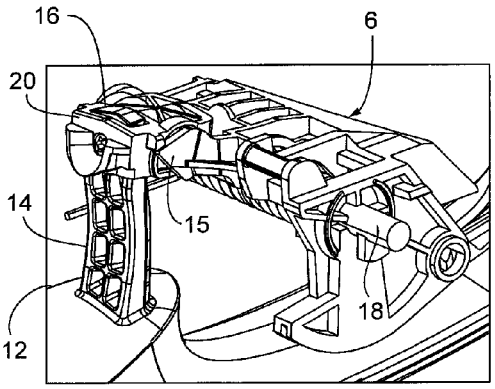
FIG. 16 shows a perspective view of the coupling device and the joint element in the inactive position, when the handle has not been actuated.
Figure 17:
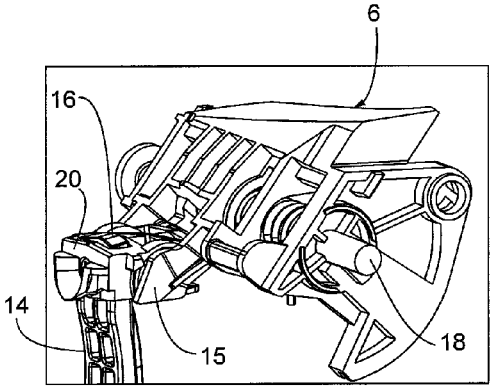
FIG. 17 shows a perspective view of the coupling device and the joint element in the end position, when the handle has been actuated.

FIGS. 12, 14 and 16 show various views of the inactive position, while, in contrast, FIGS. 13, 15 and 17 show views, corresponding to FIGS. 12, 14 and 16, in which the handle 4 is located in its end position. In the inactive position, the handle hook 14 is oriented nearly perpendicular to the two-armed deflection lever 15. Furthermore, in the inactive position, the arms 26 of the deflection lever 15 are disposed in a line to the joint element 20, such that the articulated connection 29 exhibits a type of extended state. When the handle 4 is actuated, the handle hook 14 moves substantially vertically downward, with respect to FIGS. 12 to 17. As a result of this movement of the handle hook 14 of the handle 4, the joint element, non-pivotably connected to the free end 16, likewise moves downward, thus away from the handle mount 7. Because of the moveable coupling of the second handle end 12 of the handle 4 with the deflection lever 15 of the mechanical coupling device 6, which is obtained by means of the articulated connection 29, the deflection lever is also moved downward, away from the handle mount 7, by means of which the coupling device 6 and the rotational axle element 18, pivotably supported in the bearing points 19, rotates. Furthermore, the deflection lever 15 is pivoted thereby in relation to the joint element 20, which is possible by means of the joint pins 25 pivotably supported in the receiving recesses 27 (see FIG. 13, for example). As a result, the articulated connection 29 exhibits a type of curved state, in which the deflection lever 15 is pivoted in relation to the handle hook 14 of the handle 4, which is possible by means of the hinge-like articulated connection 29, which comprises both the form-locking connection 30 between the handle hook 14 and the joint element 20, as well as the pivot joint connection 28 between the joint element 20 and the deflection lever 15.

Figure 8:
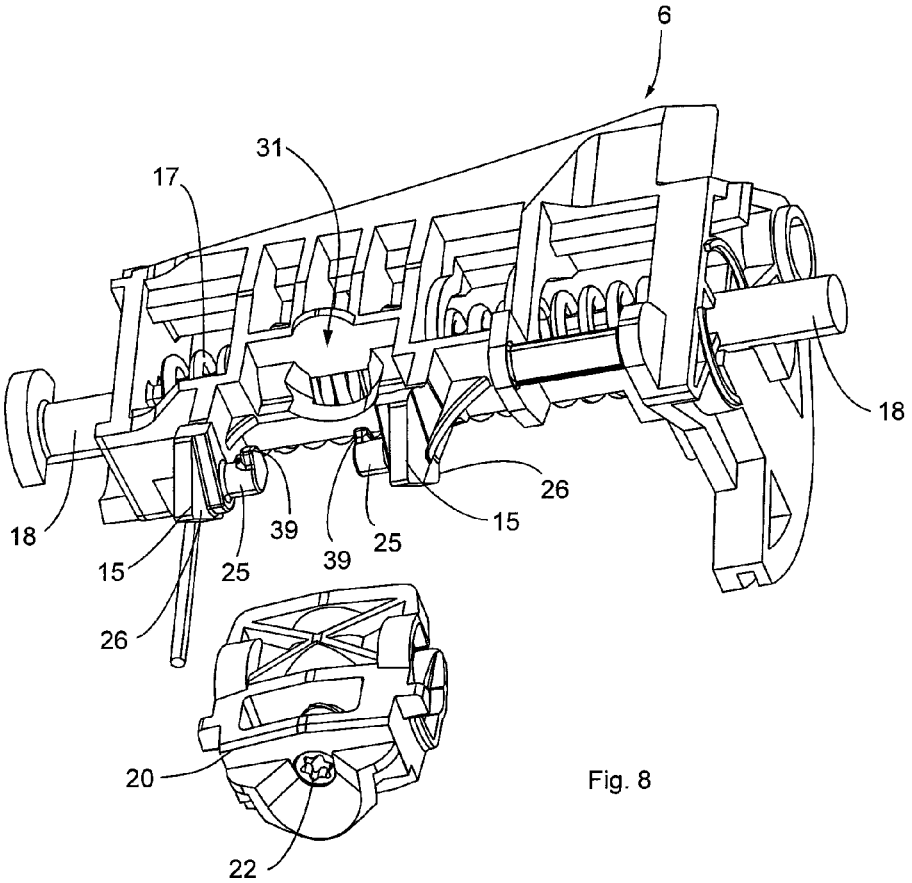
FIG. 8 shows the installation element and a mechanical coupling device before they are assembled, in a perspective view.

The receiving recesses 27, which are open at one end, toward the mechanical coupling device 6, are each designed with at least one step 38 in the cross-section (see FIG. 6, for example), while, in contrast, the joint pins 25 each have, at least in sections, an expanded head 39 (see FIG. 8, for example). The expanded head 39 is designed as a bulge having the shape of a circle segment in the embodiment example shown here, which is disposed such that it lies behind the step 38 of the joint element 20, and prevents a lateral relative movement of the joint element 20 and the coupling device 6. This expanded head 29 is disposed in each case such that it lies behind the step 38 inside the joint element 20 (as can be seen, for example, in FIGS. 12 and 13), such that a lateral movement of the deflection lever 15 is prevented.

The invention described above is, as a matter of course, not limited to the described and depicted embodiment. It is apparent that numerous changes can be made to the embodiment depicted in the drawings, which are obvious to the person skilled in the art, depending on the intended use, without abandoning the scope of the invention thereby. Everything contained in the description and/or depicted in the drawings belongs to the invention, including that which is obvious to the person skilled in the art, deviating from the concrete embodiment example.

The invention claimed is:

1. A door handle assembly for a motor vehicle, comprising a handle mount, a handle for opening a door or hatch on the motor vehicle and a mechanical coupling device, wherein the handle is pivotably supported in the region of a first handle end on the handle mount that can be installed on the inside of the vehicle, and, in the region of a second handle end, the handle is coupled to the mechanical coupling device, which is pivotably supported on the handle mount, and by means of which, an actuation of the handle can be transferred to a vehicle-side closing assembly, wherein the second handle end of the handle and a deflection lever of the mechanical coupling device are moveably coupled to one another by a pivotable and hinge-like articulated connection of the second handle end in relation to the deflection lever, when the handle has been actuated, wherein the pivotable and hinge-like articulated connection comprises a joint element, which is non-pivotably connected to a handle hook of the handle formed on the second handle end via a form-locking connection, and which is pivotably connected to the deflection lever via a pivot joint connection, wherein the form-locking connection comprises a screw, screwed into a thread in the joint element, which fixes the free end of the handle hook in place, and wherein, for the installation of the free end of the handle hook of the handle on the deflection lever of the coupling device, the deflection lever is kept stationary by the screw, in that the screw protrudes out of the joint element, such that its screw head rests against a contact surface formed on the coupling device, such that a relative movement between the joint element and the coupling device is blocked.

2. The door handle assembly according to claim 1, wherein, with the form-locking connection, the screw is inserted through a through hole formed on the free end of the handle hook, and the screw is screwed into the joint element, such that its head rests against the joint element.

3. The door handle assembly according to claim 1, wherein the pivot joint connection comprises at least one receiving recess formed in the joint element, and at least one joint pin protruding laterally from the deflection lever, wherein the at least one joint pin is pivotably supported in the at least one receiving recess.

4. The door handle assembly according to claim 3, wherein the at least one receiving recess is designed such that it has at least one step in the cross-section, and the at least one joint pin exhibits a head that is expanded at least in sections, of which at least one section is disposed such that it lies behind the at least one step inside the joint element.

5. The door handle assembly according to claim 1, wherein the joint element has an installation funnel facing the screw, for inserting and orienting a tool for adjusting the position of the screw in the joint element.

6. The door handle assembly according to claim 5, wherein an additional funnel of an installation aid is disposed in a virtual extension of the installation funnel, wherein the installation aid is fixed on the handle mount by means of locking connection elements, such that it can be dismantled, or is designed as an integral part of the handle mount.

7. The door handle assembly according to claim 1, wherein the articulated connection is designed in the manner of a pivot joint or hinge, and the deflection lever of the coupling device is pivotably connected to the handle in the region of the second handle end.

8. The door handle assembly according to claim 1, wherein the first handle end of the handle is tightened down securely.

9. The door handle assembly according to claim 1, wherein the pivot joint connection comprises at least one receiving recess formed in the joint element, and at least one joint pin protruding laterally from the deflection lever, wherein the at least one joint pin is pivotably supported in the at least one receiving recess.

10. The door handle assembly according to claim 2, wherein the pivot joint connection comprises at least one receiving recess formed in the joint element, and at least one joint pin protruding laterally from the deflection lever, wherein the at least one joint pin is pivotably supported in the at least one receiving recess.

11. The door handle assembly according to claim 2, wherein the joint element has an installation funnel facing the screw, for inserting and orienting a tool for adjusting the position of the screw in the joint element.

12. The door handle assembly according to claim 1, wherein the joint element has an installation funnel facing the screw, for inserting and orienting a tool for adjusting the position of the screw in the joint element.

13. The door handle assembly according to claim 3, wherein the joint element has an installation funnel facing the screw, for inserting and orienting a tool for adjusting the position of the screw in the joint element.

14. The door handle assembly according to claim 4, wherein the joint element has an installation funnel facing the screw, for inserting and orienting a tool for adjusting the position of the screw in the joint element.

* * * * *